US009551549B1

(12) United States Patent
Chvala

(10) Patent No.: US 9,551,549 B1
(45) Date of Patent: Jan. 24, 2017

(54) MULTI-POSITION STOCK ASSEMBLY FOR STABILIZING A STOCK DURING ADJUSTMENT ALONG A BUFFER TUBE

(71) Applicant: John R. Chvala, Grafton, WI (US)

(72) Inventor: John R. Chvala, Grafton, WI (US)

( * ) Notice: Subject to any disclaimer, the term of this patent is extended or adjusted under 35 U.S.C. 154(b) by 0 days.

(21) Appl. No.: 15/017,709

(22) Filed: Feb. 8, 2016

(51) Int. Cl.
*F41C 23/14* (2006.01)
*F41C 23/04* (2006.01)
*F41C 7/00* (2006.01)

(52) U.S. Cl.
CPC ..... *F41C 23/14* (2013.01); *F41C 7/00* (2013.01); *F41C 23/04* (2013.01)

(58) Field of Classification Search
CPC ..... F41C 23/00; F41C 23/04; F41C 23/14; F41C 23/20
USPC ..... 42/75.03, 73
See application file for complete search history.

(56) References Cited

U.S. PATENT DOCUMENTS 7,823,313 B2 * 11/2010 Faifer ..... F41C 23/06 42/1.06
7,984,580 B1 * 7/2011 Giauque ..... F41C 23/06 42/73
8,191,299 B2 * 6/2012 Faifer ..... F41C 23/06 29/592
8,402,683 B2 * 3/2013 Cabahug ..... F41C 23/04 42/71.01
8,656,623 B1 2/2014 Chvala
8,978,284 B1 * 3/2015 Zusman ..... F41C 23/14 42/1.06
8,978,285 B1 * 3/2015 Burke ..... F41C 23/14 42/73
9,261,324 B1 * 2/2016 Liang ..... F41C 23/04
9,404,708 B1 * 8/2016 Chow ..... F41C 23/14
9,488,435 B1 * 11/2016 Roberts ..... F41C 23/14
2010/0115817 A1 * 5/2010 Faifer ..... F41C 23/06 42/71.01
2010/0275489 A1 * 11/2010 Cabahug ..... F41C 23/22 42/71.01
2014/0259848 A1 * 9/2014 Chvala ..... F41C 23/14 42/73
2015/0052795 A1 * 2/2015 Burke ..... F41C 23/14 42/71.01
2015/0276343 A1 * 10/2015 Zusman ..... F41C 23/04 42/71.01
2016/0187099 A1 * 6/2016 Cottle ..... F41C 23/14 42/73
2016/0258713 A1 * 9/2016 Huang ..... F41A 3/66
2016/0305738 A1 * 10/2016 Huang ..... F41C 23/04
(Continued)

*Primary Examiner* — Derrick Morgan
(74) *Attorney, Agent, or Firm* — Andrus Intellectual Property Law, LLP

(57) ABSTRACT

An adjustable stock assembly for a firearm includes a buffer tube extending rearwardly from a receiver, and provided with a series of recesses formed in a bottom portion thereof. A stock has a front end mounted for longitudinal axial sliding movement along the buffer tube, and a rear end provided with a butt plate. A lever arrangement is mounted on the stock for slidable movement therewith along the buffer tube to selectively engage and disengage with any one of the recesses formed in the buffer tube. The lever arrangement is positioned between the buffer tube and the stock, and is configured to prevent any movement of the stock relative to the buffer tube other than the longitudinal axial sliding movement of the stock along the buffer tube.

18 Claims, 6 Drawing Sheets

(56) References Cited

U.S. PATENT DOCUMENTS

2016/0327361 A1* 11/2016 Roberts ..... F41C 23/14

* cited by examiner

MULTI-POSITION STOCK ASSEMBLY FOR STABILIZING A STOCK DURING ADJUSTMENT ALONG A BUFFER TUBE

BACKGROUND

The present disclosure relates generally to firearms, and more particularly, pertains to a variably configurable stock assembly for a firearm.

There has been a long-standing recognition as to the desirability of firearms in which the stock can be moved between various positions which provide the shooter with the desired length of pull for comfort and accurate shooting. The adjustable positioning of the stocks is useful during transport, storage and use of firearms, and is particularly advantageous in certain tactical situations. Sliding stocks are known to have a stock assembly in which a butt stock is slidably adjustable along a fixed support member, such as buffer tube, between one or more collapsed and extended shoulder-engaging positions.

Attempts have been made to advance the functionality of the adjustable stock assembly to include different adjustable configurations, but generally have been found not to be reliable and durable over repeated operation. Previous variably configurable stock assemblies have been unsatisfactory due to, among other things, numerous pieces or parts which can undesirably increase the weight of the assembly, problematic assembly and operation, expensive product costs and a susceptibility to dirt and grit encountered in the field which can negatively affect use. One particular problem which occurs in the use of prior art adjustable sliding stock assemblies is an undesirable side to side (or horizontal) and vertical movement of the stock relative to the buffer tube which prevents a smooth and quiet stock adjustment Accordingly, their remains a need to provide a firearm stock assembly which incorporates an enhanced adjustable shoulder stock assembly which overcomes the shortcomings of the previous designs.

SUMMARY

The present disclosure relates to an adjustable stock assembly for a firearm having a receiver. The stock assembly includes a buffer tube extending rearwardly from the receiver, and provided with a series of recesses formed in a bottom portion thereof. A stock has a front end mounted for longitudinal axial sliding movement along the buffer tube, and a rear end provided with a butt plate. A lever arrangement is mounted on the stock for slidable movement therewith along the buffer tube to selectively engage and disengage with any one of the recesses formed on the buffer tube for locking the stock in various axial positions along the buffer tube. The lever arrangement is positioned between the buffer tube and the stock, and is configured to prevent any movement of the stock relative to the buffer tube other than the longitudinal axial sliding movement of the stock along the buffer tube.

The present disclosure also relates to an adjustable stock assembly for a firearm having a receiver. The stock assembly includes a buffer tube extending rearwardly from the receiver, and constructed with a tubular body having a depending bottom member provided with opposing side walls and a channel formed with a series of recesses therein. A stock has a front end mounted for longitudinal axial sliding movement along the buffer tube, and a rear end provided with a butt plate. A lever arrangement is mounted on the stock for slidable movement therewith along the buffer tube to selectively engage and disengage with any of the recesses formed in the buffer tube for locking the stock in various axial positions along the buffer tube. The lever arrangement includes a lever base which is slidably received and retained in the front end of the stock, and formed with a set of opposing resilient members that are in continuous frictional engagement with outer surfaces of the opposing side walls on the bottom member of the buffer tube.

The present disclosure further relates to an adjustable stock assembly for a firearm having a receiver. The stock assembly includes a buffer tube extending rearwardly from the receiver, and constructed with a tubular body having a depending bottom member provided with opposing side walls and a channel with a series of recesses formed therein. A stock has a front end mounted for longitudinal axial sliding movement along the buffer tube, and a rear end provided with a butt plate. A lever arrangement is mounted on the stock for slidable movement therewith along the buffer tube to selectively engage and disengage with any of the recesses formed in the buffer tube for locking the stock in various axial positions along the buffer tube. The lever arrangement includes a lever base having a lower end which is slidably received and retained in the front end of the stock, and an upper resilient end in continuous frictional engagement with the outer surfaces of the opposing side walls on the bottom member of the buffer tube. The lever base is connected between the stock and the buffer tube to prevent any movement of the stock relative to the buffer tube other than the longitudinal axial sliding movement of the stock along the buffer tube.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
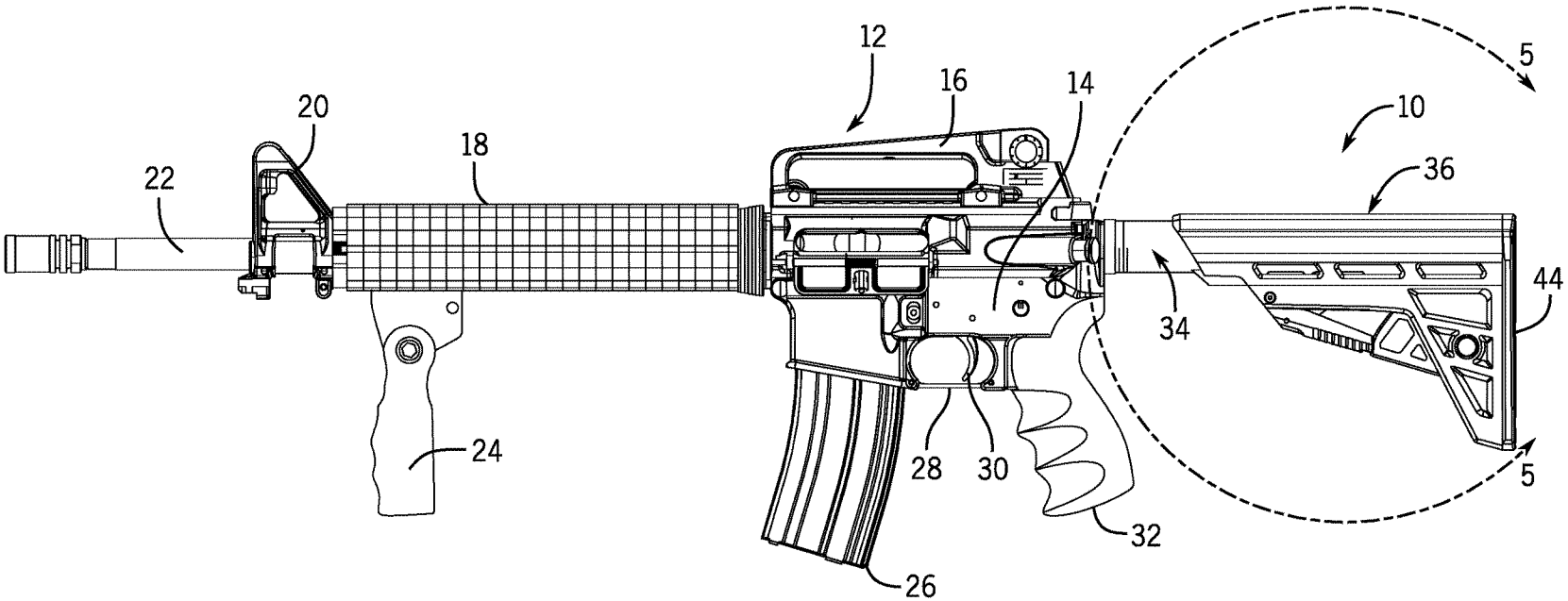
FIG. 1 is an elevational view of a firearm provided with an adjustable stock assembly for stabilizing a stock during adjustment along a buffer tube.

Referring now to the drawings, FIG. 1 illustrates an adjustable stock assembly 10 movably attached to a rear portion of a firearm, such as automatic rifle 12.

Rifle 12 typically includes a receiver 14, a transport handle 16, a hand guard 18, a forward sight 20 and a barrel 22. The rifle 12 also includes a forward hand grip 24, a magazine 26, a trigger guard 28, a trigger 30 and a pistol grip 32.

In accordance with the present disclosure, the adjustable stock assembly 10 is generally comprised of a stationary stock support in the form of a buffer tube 34 extending rearwardly from the receiver 14, and a stock 36 adjustably mounted for sliding movement on the buffer tube 34. The outer surface of the buffer tube 34 and the inner surface of the stock 36 are configured for continuous engagement with one another to permit the desired sliding movement of the stock relative to the buffer tube 34 along the longitudinal axis thereof.

Figure 2:
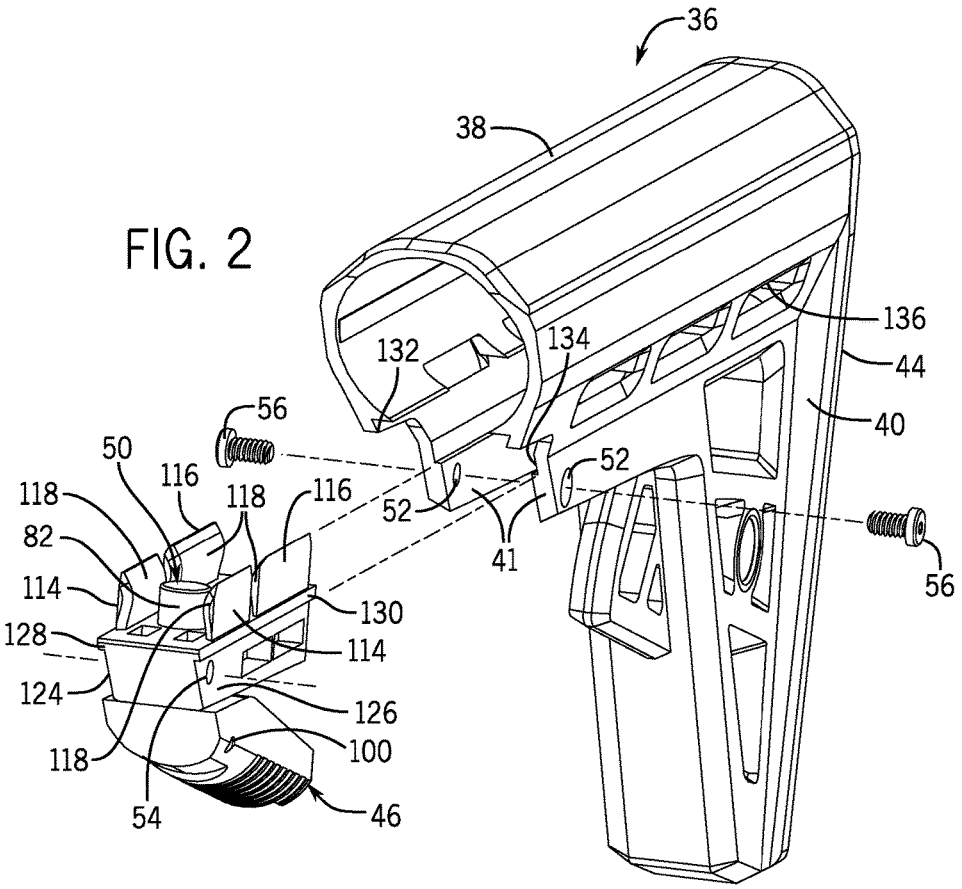
FIG. 2 is an exploded perspective view of the stock and a lever arrangement used in the stock assembly.

Referring now to FIG. 2, the stock 36 is integrally formed with a tubular upper portion 38 and a depending lower portion 40 having spaced apart side walls 41. The upper portion 38 has an open forward end 42 which slidably receives an outer surface of the buffer tube 34. A butt plate 44 is attached, such as by fasteners, to a rear end of the upper and lower portions 38, 40. As is well known, the butt plate 44 along with a butt pad insert and a butt pad are adapted to engage the shoulder of a shooter during use of the rifle 12.

As also seen in FIG. 2, a lever 46, a stabilizing lever base 48 and a latch pin 50 together form a lever arrangement which is designed to be slidably received at the forward open end 42 of the lower portion 40 of the stock 36. Holes 52 formed in opposed side walls 41 on the lower portion 40 of the stock 36 are aligned with apertures 54 on opposite sides of the stabilizing lever base 48. Screw fasteners 56 are passed through the aligned holes 52 and apertures 54 to fixedly mount the lever arrangement within the lower portion 40 of the stock 36 for movement therewith along the buffer tube 34. The lever 46, the stabilizing lever base 48 and the latch pin 50 are used to establish selective positioning of the stock 36 in different adjustment locations along a longitudinal axis of the buffer tube 34 as will be further understood below.

Figure 3:
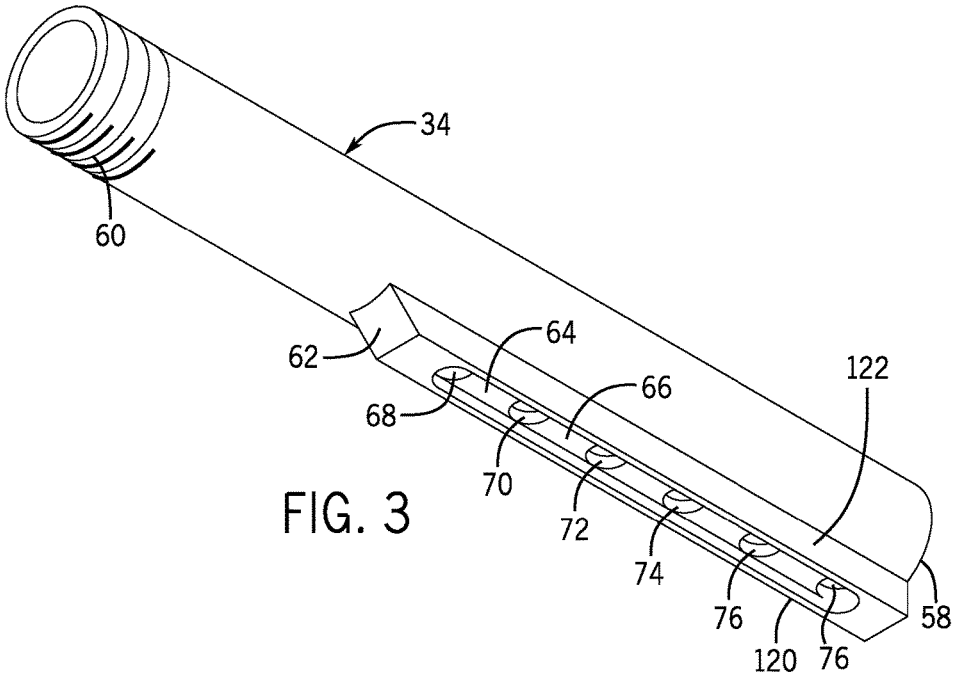
FIG. 3 is a perspective view of the buffer tube of the stock assembly.

Referring now to FIG. 3, the buffer tube 34 has a closed end 58, and a threaded forward open end 60 which is designed to be screwthreaded into a mounting structure at the rear of the receiver 14. The buffer tube 34 has a depending elongated bottom member 62 provided with a downwardly facing recessed channel 64 exposing a flat surface 66 formed with a lock receiving structure. The lock receiving structure is defined by a series of spaced a part cylindrical latch pin receiving recesses 68, 70, 72, 74, 76, 78 which serve to establish different axial positions for the sliding stock 36 along the buffer tube 34.

Figure 4:
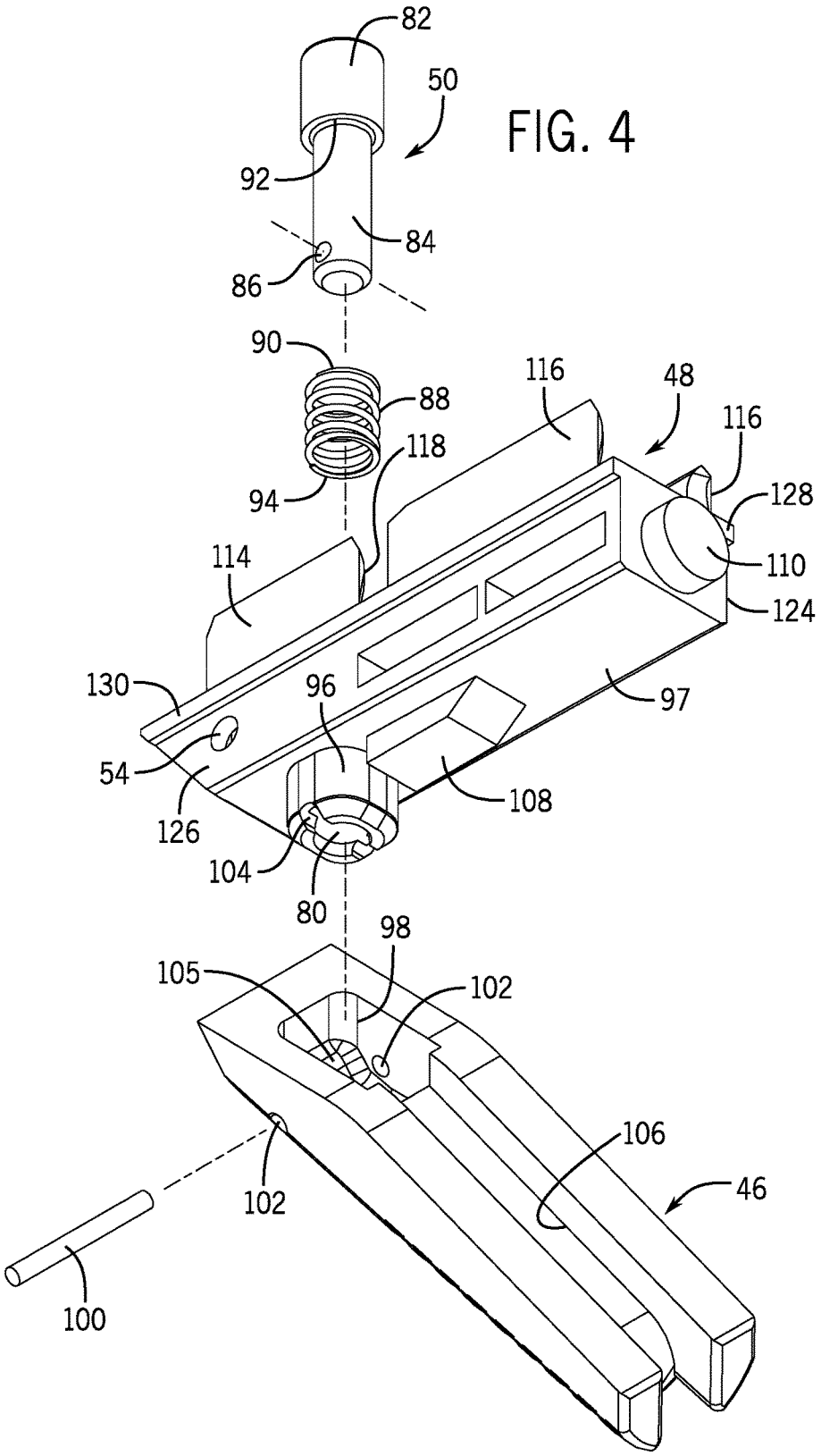
FIG. 4 is an exploded view of the lever arrangement shown in FIG. 2.
Figure 6:
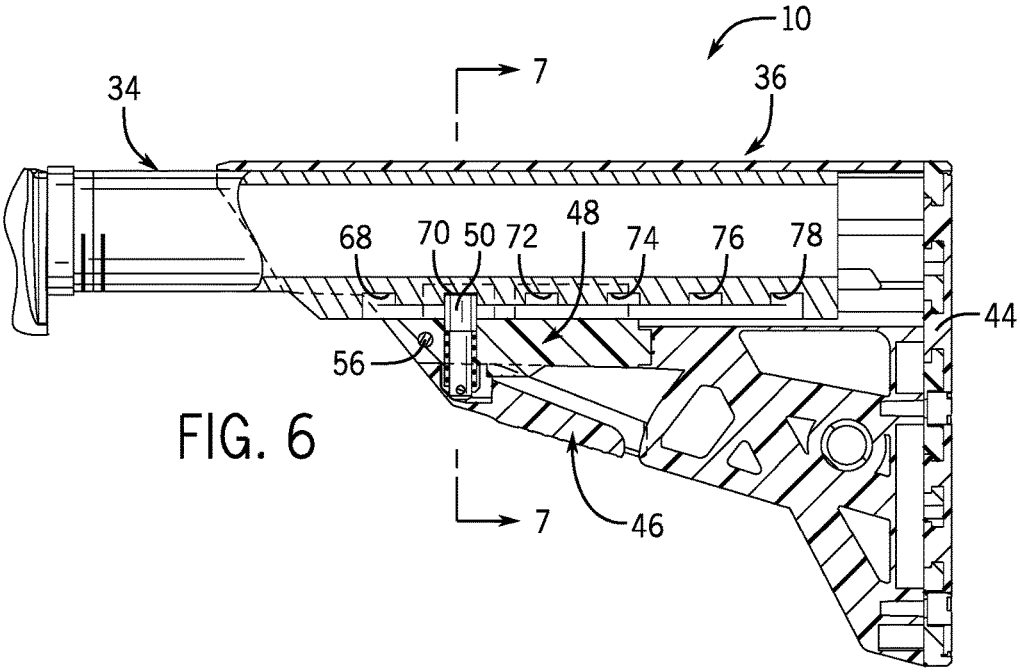
FIG. 6 is a partial sectional view of the stock assembly shown in FIG. 5.
Figure 10:
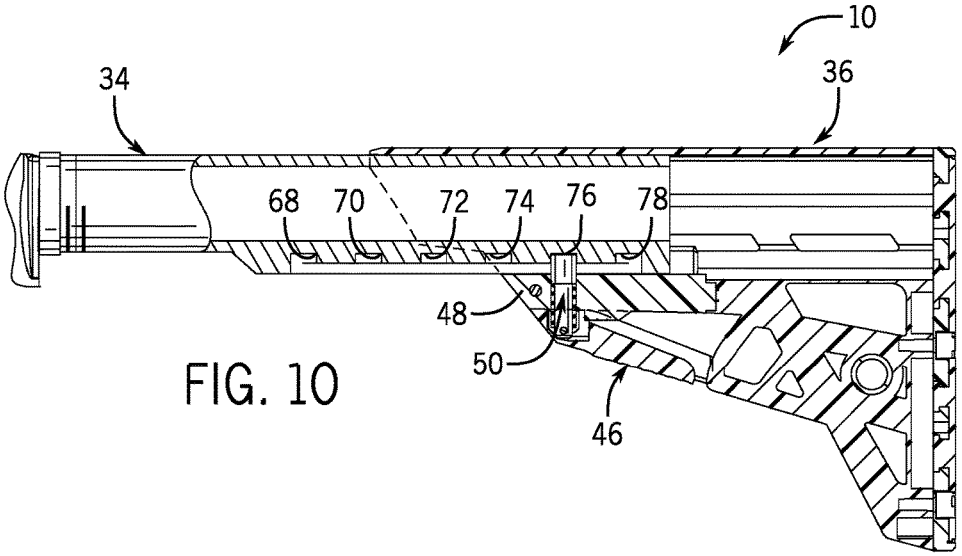
FIG. 10 is a partial sectional view of FIG. 9.

FIG. 4 illustrates further details of the lever arrangement 46, 48, 50 shown in FIG. 2. Latch pin 50 defines a locking structure and is designed to be received in a cylindrical passageway 80 (FIG. 7) formed entirely through the stabilizing lever base 48. The latch pin 50 has an upper cylindrical portion 82 and a lower cylindrical portion 84 having a reduced diameter compared to upper cylindrical portion 82. Upper cylindrical portion 82 is designed to lockingly engage with walls of the buffer tube recesses 68, 70, 72, 74, 76, 78. Lower cylindrical portion 84 is provided with a throughhole 86 and is surrounded by a coil spring 88 which is received in the passageway 80. The coil spring 88 has an upper end 90 which abuts a bottom wall 92 of the upper cylindrical portion 82. A lower end 94 of the spring 88 seats against an inside surface of the bottom of a tubular boss 96 depending from a bottom surface 97 of stabilizing lever base 48. The lower cylindrical portion 84 of the latch pin 50 projects through the boss 96, and is received in a recess 98 formed within a front portion of the lever 46. A retaining pin 100 is passed through opposing holes 102 provided in opposing side walls of the lever 46, grooves 104 in the lower end of the boss 96 and the throughhole 86 to hold the latch pin 50 and the lever 46 in a normally upwardly biased position as depicted in FIGS. 6 and 10 when it is desired to lock the stock 36 in a particular axial position along the buffer tube 34.

Figure 8:
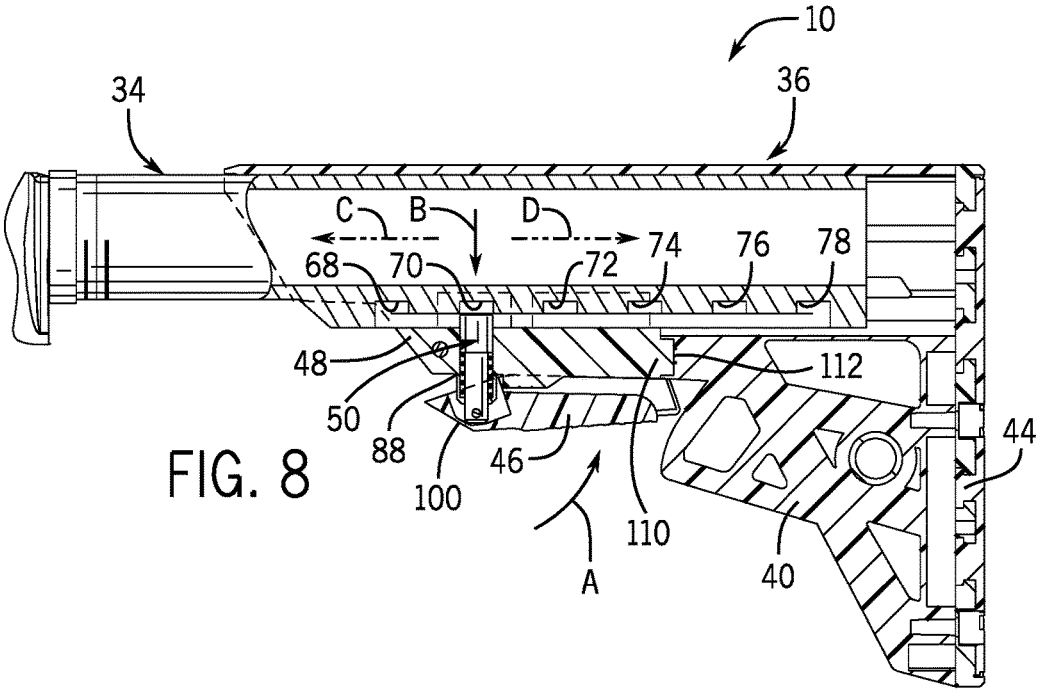
FIG. 8 is a sectional view similar to FIG. 6 showing use of the lever arrangement to enable axial movement of the stock relative to the buffer tube.

It can also be seen that the forward end of the lever 46 is provided with an engagement surface 105 which turns about the lower end of the boss 96 when a force is applied to a rearward end of the lever 46 causing the lever 46 to pivot about the retaining pin 100 as depicted in FIG. 8. When the lever 46 is pivoted in the direction of arrow A, the walls of a channel 106 receive outer surfaces of a guide member 108 depending from the bottom surface 97 of the stabilizing lever base 48. At the same time, the latch pin 50 is pulled downwardly in the direction of arrow B compressing the spring 88 and removing the upper cylindrical portion 82 of the latch pin 50 from engagement with the walls of locking recess 70. Once the upper cylindrical portion 82 of the latch pin 50 has been completely withdrawn from the locking recess 70, the stock 36 may be slidably longitudinally and axially adjusted along buffer tube 34 in the direction of arrows C or D to a different locking position defined by the remaining recesses 68, 72, 74, 76, 78. A rearward end of the stabilizing lever base 48 is provided with a projection 110 which is received and retained in a recess 112 formed in the lower portion 40 of the stock 36.

Figure 7:
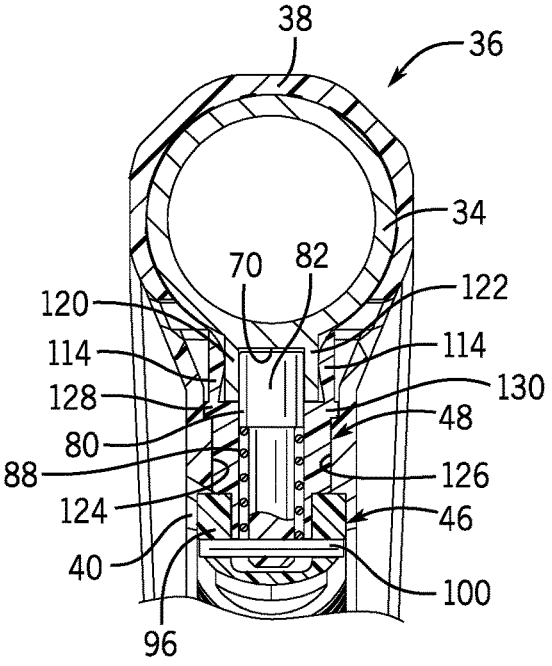
FIG. 7 is a sectional view of the stock assembly taken on line 7-7 of FIG. 6.

Referring now to FIG. 2, a salient feature of the present disclosure resides in the provision of a set of resilient members which extend upwardly from opposed side edges at the top of the stabilizing lever base 48. More particularly, the resilient member includes a pair of forward spaced apart resilient fins 114, and a pair of rearward spaced apart resilient fins 116. Each of the fins 114, 116 has curved inner surfaces 118 which are continuously frictionally engaged with outer surfaces of longitudinally extending side walls 120, 122 of the bottom member 62 on buffer tube 34 when the stock 36 is mounted on the buffer tube 34 as best seen in FIG. 7. Top edges of the fins 114, 116 extend up to and are frictionally engaged against lower curved portions of the buffer tube 34.

In addition, it should be noted that opposed side walls 124, 126 and outer surfaces of the boss 96 on the lever base 48 are snug fit against inner surfaces of the lower portion 40 of the stock 36 and against the lever 46. Laterally projecting side edges 128, 130 of the lever base 48 are tightly engaged with the walls of recesses 132, 134 (FIG. 2) formed in the lower portion 40 of the stock 36. As a result, incorporating the lever base 48 with its resilient fins 114, 116 in the stock assembly 10 ensures that no unnecessary gaps are created between cooperating elements of the stock assembly 10, and serves to stabilize and permit only the sliding motion of the stock 36 relative to the buffer tube 34 so that no other relative motion is permitted between the stock 36 and the buffer tube 34 as a result of stock adjustment.

It should be appreciated that in prior art adjustable stock assemblies such as disclosed in U.S. Patent Application Publication No. 2014/0259848, which is incorporated herein by reference, both vertical and side to side (horizontal) movement of the stock relative to the buffer tube can occur which may lead to unwanted noise and a wobbly adjustment. In contrast, the lever base 48 of the present disclosure is particularly configured such that any motion (e.g. horizontal and vertical) of the stock relative to the buffer tube other than sliding movement of the stock relative to the buffer tube along the longitudinal axis is prevented which results in a desired smooth and quiet stock adjustment.

Figure 5:
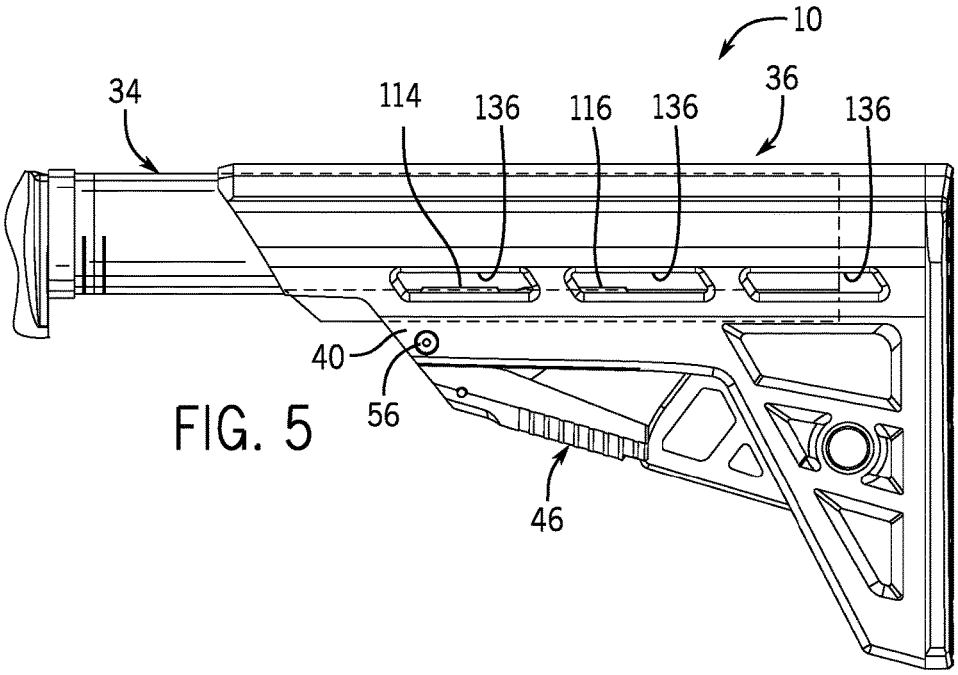
FIG. 5 is an enlarged detail view of the stock assembly illustrated on line 5-5 of FIG. 1 and shown in one locked adjustment position.
Figure 9:
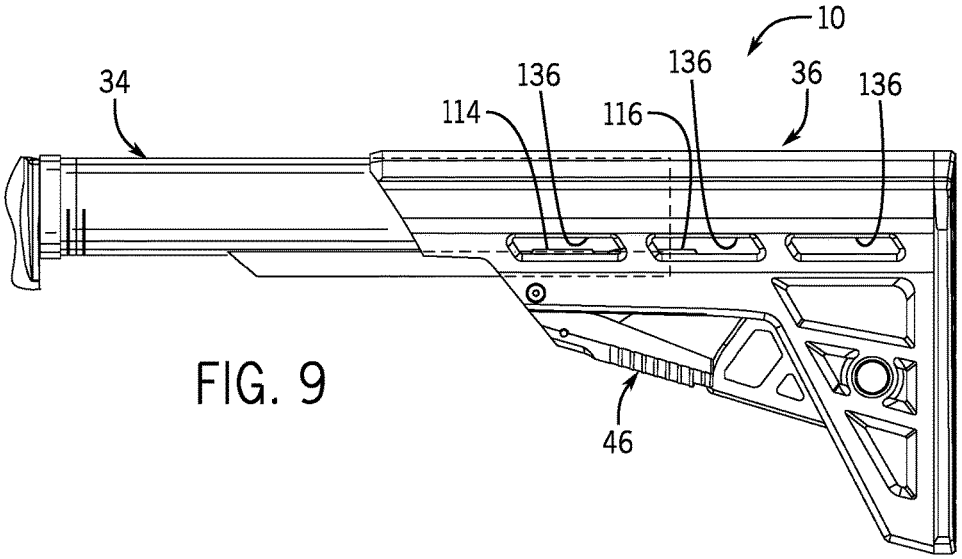
FIG. 9 is an elevational view of the stock assembly shown in another locked adjustment position different from that shown in FIG. 5.

When installed in the stock assembly 10, the top of the fins 114, 116 are visible through material relieved openings 136 formed along opposite sides of the stock 36 as shown in FIGS. 5 and 9.

Should it become desirable to adjust the axial position of the stock 36 on buffer tube 34, a user of the stock assembly 10 presses the lever 46 as described above with reference to FIG. 8. This action releases the upper cylindrical portion 82 of the latch pin from engagement with a selected one of the locking recesses, such as recess 70, to enable free sliding adjustment of the stock 36 including the lever assembly 46, 48, 50 along the buffer tube 34 to a different desired axial position, such as exemplified in FIG. 10. If desired, continuous pressure on the lever 46 will enable the stock 36 and the connected lever arrangement 46, 48, 50 to be slidably removed from the buffer tube 34. Although six recesses 68, 70, 72, 74, 76, 78 are shown illustrating six discreet adjustment positions, it should be understood that any number of recesses could be provided to define any number of adjustment positions.

Various alternatives are contemplated as being within the scope of the following claims particularly pointing out and distinctly claiming the subject matter regarded as the invention.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An adjustable stock assembly for a firearm having a receiver, the stock assembly comprising:

a buffer tube extending rearwardly from the receiver, and provided with a series of recesses formed in a bottom member;

a stock having a front end mounted for longitudinal axial sliding movement along the buffer tube, and a rear end provided with a butt plate; and a lever arrangement is mounted on the stock for slidable movement therewith along the buffer tube to selectively engage and disengage with any of the recesses formed on the buffer tube for locking the stock in various axial positions along the buffer tube, wherein the lever arrangement is positioned between the buffer tube and the stock, and is configured to prevent any movement of the stock relative to the buffer tube other than the longitudinal axial sliding movement of the stock along the buffer tube;

wherein the lever arrangement includes a lever base formed with a set of resilient members that are continuously engaged against outer surfaces of spaced apart opposing side walls at the front end of the stock; and wherein the resilient members have top edges which extend up to and contact the tubular body.

2. The adjustable stock assembly of claim 1, wherein the lever arrangement is slidably received and retained in the front end of the stock.

3. The adjustable stock assembly of claim 1, wherein the resilient members are formed as resilient fins extending upwardly from opposing side edges of the lever base.

4. An adjustable stock assembly for a firearm having a receiver, the stock assembly comprising:

a buffer tube extending rearwardly from the receiver, and constructed with a tubular body having a depending bottom member provided with opposing side walls and a channel formed with a series of recesses therein;

a stock having a front end mounted for longitudinal axial sliding movement along the buffer tube, and a rear end provided with a butt plate; and a lever arrangement mounted on the stock for slidable movement therewith along the buffer tube to selectively engage and disengage with any of the recesses formed in the buffer tube for locking the stock in various axial positions along the buffer tube, wherein the lever arrangement includes a lever base which is slidably received and retained in the front end of the stock, and formed with a set of opposing resent members that are in continuous frictional engagement with outer surfaces of the opposing side walls of the bottom member of the buffer tube; and wherein the resilient members have top edges which extend up to and contact the tubular body.

5. The adjustable stock assembly of claim 4, wherein the lever base is configured to prevent any movement of the stock relative to the buffer tube other than longitudinal axial sliding movement of the stock along the buffer tube.

6. The adjustable stock assembly of claim 4, wherein the lever base is slidably received and retained between a pair of spaced apart side walls at the front end of the stock.

7. The adjustable stock assembly of claim 4, wherein the resilient members are defined by a pair of forward spaced apart resilient fins and a pair of rearward spaced apart resilient fins.

8. The adjustable stock assembly of claim 7, wherein the resilient fins extend upwardly from opposing side edges of the lever base.

9. The adjustable stock assembly of claim 8, wherein each of the fins has a curved inner surface.

10. The adjustable stock assembly of claim 4, wherein a bottom surface of the lever base is formed with a depending tubular boss defining a passageway extending completely through the lever base.

11. The adjustable stock assembly of claim 10, wherein the boss receives and retains a spring which surrounds a lower portion of a latch pin mounted for movement within the walls of the passageway.

12. The adjustable stock assembly of claim 11, wherein the latch pin has an upper portion which is joined to the lower portion and which is selectively engagable and disengagable with any one of the recesses formed in the buffer tube.

13. The adjustable stock assembly of claim 4, wherein a rearward end of the lever base is formed with a projection which is received and retained in a recess formed in the stock.

14. The adjustable stock assembly of claim 11, wherein the bottom surface of the lever base includes a guide member located rearwardly of the tubular boss.

15. The adjustable stock assembly of claim 14, wherein the lever arrangement includes a lever connected to the latch pin and having a recess for receiving the tubular boss and the lower portion of the latch pin such that the lever will pivot relative to the lever base.

16. The adjustable stock assembly of claim 15, wherein the lever includes a channel defined by walls which are configured to receive the guide member.

17. The adjustable stock assembly of claim 15, wherein the lever base has an upper end which contacts the tubular body of the buffer tube and a lower end on which the lever pivots.

18. An adjustable stock assembly for a firearm having a receiver, the stock assembly comprising:

a buffer tube extending rearwardly from the receiver, and constructed with a tubular body having a depending bottom member provided with opposing side walls and a channel with a series of recesses formed therein;

a stock having a front end mounted for longitudinal axial sliding movement along the buffer tube, and a rear end provided with a butt plate; and a lever arrangement mounted on the stock for slidable movement therewith along the buffer tube to selectively engage and disengage with any of the recesses formed in the buffer tube for locking the stock in various axial positions along the buffer tube, wherein the lever arrangement includes a lever base having a lower end which is slidably received and retained in the front end of the stock, and an upper resent end in continuous frictional engagement with outer surfaces of the opposing side walls on the bottom member of the buffer tube, the lever base being connected between the stock and the buffer tube to prevent any movement of the stock relative to the buffer tube other than the longitudinal axial sliding movement of the stock along the buffer tube; and wherein the upper resilient end extends up to and contacts the tubular body.

* * * * *